US007072598B2

(12) United States Patent
Takayanagi

(10) Patent No.: US 7,072,598 B2
(45) Date of Patent: Jul. 4, 2006

(54) METHOD FOR DETERMINING PROPER BIAS VOLTAGE FOR TRANSFERRING TONER IMAGE FROM PHOTOCONDUCTIVE DRUM TO INTERMEDIATE TRANSFER BELT AND IMAGE FORMING APPARATUS INCORPORATING THE SAME

(75) Inventor: Hiroki Takayanagi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 10/826,555

(22) Filed: Apr. 15, 2004

(65) Prior Publication Data

US 2004/0213594 A1 Oct. 28, 2004

(30) Foreign Application Priority Data

Apr. 24, 2003 (JP) ..... 2003-120290

(51) Int. Cl.
*G03G 15/16* (2006.01)

(52) U.S. Cl. ..... 399/66

(58) Field of Classification Search ..... 399/66, 399/314

See application file for complete search history.

(56) References Cited

U.S. PATENT DOCUMENTS 5,646,717 A 7/1997 Hiroshima
5,953,572 A * 9/1999 Takeuchi et al. ..... 399/66 X
6,253,038 B1 * 6/2001 Ito et al. ..... 399/66 X
6,404,999 B1 * 6/2002 Shoji et al. ..... 399/66
2002/0106210 A1 * 8/2002 Oki ..... 399/66

FOREIGN PATENT DOCUMENTS

JP 5-6112 A 1/1993
JP 10-133495 A 5/1998

* cited by examiner

*Primary Examiner*—Sandra I. Brase
(74) *Attorney, Agent, or Firm*—Canon U.S.A. Inc IP Division

(57) ABSTRACT

A system and method for determining, during a pre-rotation period, a proper transfer bias for colors, e.g. YMCK. These proper transfer bias voltages are applied to a primary transfer roller, which enables proper transfer of color images from a photoconductive drum. Four exposure bias voltages for each of YMCK are determined. The first exposure bias voltage for Y is applied to the photoconductive drum, while three predetermined voltages are applied to a primary transfer roller in order to obtain corresponding currents and a voltage/current relationship thereof, from which a proper transfer bias voltage for Y is determined. For all subsequent colors, a proper transfer bias voltage for each subsequent color is determined by employing the Y exposure bias voltage and the exposure bias voltage for each the subsequent colors, MCK. In an exemplary embodiment, it is noted that the proper transfer voltages are obtained during pre-rotation in which the primary transfer roller rotates no more than three times.

15 Claims, 8 Drawing Sheets

METHOD FOR DETERMINING PROPER BIAS VOLTAGE FOR TRANSFERRING TONER IMAGE FROM PHOTOCONDUCTIVE DRUM TO INTERMEDIATE TRANSFER BELT AND IMAGE FORMING APPARATUS INCORPORATING THE SAME

BACKGROUND OF THE INVENTION

1. Field of the Invention

The present invention relates to an electro-photographic or an electrostatic recording system, and specifically, relates to a method for transferring a developed image from an image carrier to a transfer material or intermediate transfer member.

2. Description of the Related Art

As shown in FIG. 5, a conventional image electro-photographic system such as a copy machine or laser printer typically includes an electro-photographic photoconductor (photoconductive drum) 1, which is an image carrier, and an electrifier 2 for electrifying the photoconductive drum 1. Other components of such a conventional electro-photographic system include an exposure unit 3 and developing devices 4Y, 5M, 6C, and 7K for color components of yellow (Y), magenta (M), cyan (C), and black (Bk), respectively. Each of these developing devices contains a magnetic material known as a developer for carrying toner.

As shown in FIG. 5, the system works by using the photoconductive drum 1 to form toner images of respective CMYK colors. For each drum rotation, toner image is electrostatically transferred onto a belt-shaped transfer medium (transfer belt 9) opposite the photoconductive drum 1. For full color images, four colors are superimposed on the intermediate transfer belt 9 one upon another and are then transferred to the transfer material 20 to form the color image.

As shown in FIG. 6, during the developing process, toner image is developed by controlling the potential on the photoconductive drum 1, which is uniformly electrified by the electrifier 2 to a drum potential Vd=+450 V. Two areas of the toner image are formed. First, a non-image portion, which is a region where no toner image is developed, is exposed by the exposure unit 3 (latent forming means) to de-staticize this area to a potential Vl=+100 V. The second area is the image area left unexposed to remain at a potential of Vd=+450 V to form an electrostatic latent image.

In FIG. 5, a development potential of Vdc=+250 V is applied to the developer device 4Y (FIG. 6) when it reaches a designated developing position of the photoconductive drum 1. As a result, development is performed on the image portion using negative toner from the developer device 4Y. Development is based both on a factor known as tribo, which is the tribo-electric charge of the toner per unit mass, and a difference in potential between Vd, the potential on the drum surface for the image portion and Vdc, the bias potential applied to the developer device 4Y, that is, Vcont=Vd−Vdc as shown in FIG. 2.

The tribo can vary depending on environmental conditions such as the absolute moisture content. When equal amounts of toner for a color are developed on the photoconductive drum 1, a smaller Vcont is needed when the tribo is low, while a larger one is needed when the tribo is high.

Even if the environmental conditions are equal, the values of tribo vary for different toner colors, and therefore, proper values of Vcont are required for each of the colors in order to develop a proper amount of toner.

The potential difference Vback between the development potential Vdc and the exposure potential Vl as shown in FIG. 6, is a potential difference for preventing a magnetic carrier from adhering to the drum and/or for inhibiting toner from adhering to a non-image region. Regarding this potential difference, in many cases, there is no problem even if the potential difference is constant irrespective of environmental conditions such as the absolute moisture content and the color.

Accordingly, when attempting to develop a proper amount of toner on the photoconductive drum 1 in the normal development, it is necessary to adjust values of Vcont to proper ones for each environment and each of the colors. In this case, the drum potential Vd is fixed, and then the exposure potential Vl is changed by an adjustment amount of the Vcont by adjusting the exposure amount of the exposure unit 3. Then, the development potential Vdc is changed by the changing amount of the exposure potential Vl, whereby Vback is adjusted so as not to change.

For example, when attempting to adjust Vcont from 200 V (FIG. 6) to 150 V, as shown in FIG. 7, the drum potential Vd is left as it is (i.e., +450 V), and then the exposure potential V1 is changed to +150 V by adjusting the exposure amount of the exposure unit 3 so that the exposure potential Vl changes by the Vcont adjustment amount 50 V. Then, the development potential Vdc is changed to +300 V by likewise changing it by 50 V. As a result, Vcont is adjusted from 200 V to 150 Vback, with Vback left as it is (i.e., 150 V).

In this manner, the adjustment of Vcont allows a satisfactory developed image to be formed. For the optimization of the developing performance of toner of respective colors, the values of Vl can be set for each of the colors.

A transfer bias is applied to a transfer member 15, which makes contact with the intermediate transfer belt 9 on the rear surface side in order to transfer images from the photoconductive drum 1. This also allows the reduction in a power supply cost by a low output. The transfer member 15 is usually a contact rotary type roller, hereinafter referred to as a "primary transfer roller 15."

Specifically, a charge opposite the toner polarity is imparted from the primary transfer roller 15 to a primary transfer region to toner image from the photoconductive drum 1 to the intermediate transfer belt 9 in an electrostatic manner.

During application of a transfer bias to the primary transfer roller 15 to pass a current having an opposite polarity with respect to toner, if the potential difference between the exposure potential Vl and primary transfer roller potential Vtr as shown in FIG. 2 is high, the current flows easily, while current flow is difficult when the potential difference is low.

Even with equal potential differences, if the resistance of the primary transfer roller 15 is higher, the current flow remains difficult.

Specifically, current flow through the primary transfer roller 15 varies depending on the exposure potential of the non-image portion of the photoconductive drum 1, and the resistance value of the primary transfer roller 15. Therefore, if the current flowing from the primary transfer roller 15 can be properly controlled, a developed toner image would be primarily transferred in a proper manner.

The resistance value of the primary transfer roller 15 is adjusted to a value on the order of $10^6$ to $10^{10}$ [Ω]. As shown in FIG. 8, a conventional transfer roller has an elastic layer 15*b* formed on the outside of an electrically conductive core metal 15*a*. The elastic layer 15*b* is provided with electrical conductivity. The transfer roller 15 is broadly classified into two types in accordance with the method for imparting an electrical conductivity.

Out of these two types of transfer rollers, one type, which has an electronic conductivity, is provided with the elastic layer 15*b* shown in FIG. 8, the elastic layer 15*b* being formed by dispersing an electrically conductive filler thereinto. Examples include an EPDM (ethylene-propylene-diene copolymer) roller and a urethane roller each of which is formed by dispersing an electrically conductive filler, such as carbon or a metal oxide, thereinto.

The other type of transfer roller 15, which has an ionic electric conductivity, comprises an ionic electric conductive material in the elastic layer 15*b*. Examples include a roller formed by providing an electrical conductivity to its material itself, such as urethane, and a roller formed by dispersing a surface-active agent into the elastic layer 15*b*.

The resistance of the transfer roller 15 is prone to vary depending on the temperature and humidity in the apparatus and energization time. As a result, once a resistance variation of the primary transfer roller 15 have occurred, it is impossible to impart a proper charge to the above-described primary transfer region. This causes apprehension that an occurrence of primary transfer defects might be induced.

Japanese Patent Laid-Open No. 10-133495 discloses a method for setting a transfer bias based on the temperature and humidity results but the amount of resistance variation due to energization during the image forming process cannot be predicted.

Also, Japanese Patent Laid-Open No. 5-6112 discloses a method that, in a pre-rotation process directly before an image forming (imaging) process, uses the transfer voltage at the time when a transfer voltage applied to the primary transfer roller 15 is increased step by step and a desired transfer current has been reached. However, if there is a large difference between a transfer voltage initially provided and an optimum transfer voltage, it will take much time to reach the desired voltage, that is, the image forming process (imaging process) will not readily start. Thus, this method has a problem in that much time elapses before getting down to the image forming operation.

To simplify circuitry, a constant voltage is used as a transfer bias. Specifically, in order to prevent the primary transfer defects caused by resistance variation of the primary transfer roller 15 during pre-rotation, another method uses the relationship between the voltage applied to the primary transfer roller 15 and the current flowing through the primary transfer region to obtain resistance so that the primary transfer voltage applied to the primary transfer roller 15 is properly controlled.

To detect resistance during the pre-rotation process, respective current values for applied predetermined voltages are detected, and based on these plural voltage and current values, a voltage-current characteristic function is specified to determine the resistance characteristic of the transfer roller.

In the present description, the "pre-rotation" refers to a time period for which each image forming means operates within the time period between the time point when a signal from outside is transmitted to the image forming apparatus and the time point when the signal arrives at the position where a first developed image is transferred, i.e., a transfer portion.

It is preferable that such a detecting operation with respect to the resistance value of the transfer roller be performed at a time during non-image forming operation, that is, when no image formation is conducted. Accordingly, here, the resistance value detecting operation is performed at a pre-rotation process. However, with the time when image formation by the transfer roller is conducted being assumed as a non-image formation time, the resistance value detecting operation may be performed even during an image forming process except during transfer process.

The resistance value of the transfer roller for transfer control is detected when the surface potential of the photoconductive drum equals a non-image portion potential (exposed portion potential Vl).

However, substantial time can also elapse before imaging actually occurs. When a plurality of predetermined voltages (e.g., voltages at three levels)are applied to the primary transfer roller 15 during pre-rotation and when the surface potential of the photoconductive drum 1 equals an exposure potential of each of the colors, the primary transfer roller 15 is rotated at least three times per color for a total of twelve rotations for four colors since the primary transfer roller 15 must be rotated once per unit level of voltage. This causes substantial time to elapse during the pre-rotation stage between the start of operation and the formation of a first image on the transfer material 20, so that productivity is reduced.

SUMMARY OF THE INVENTION

Accordingly, the present invention provides an image forming system and method capable of quickly determining an optimum transfer bias value and improving the productivity without causing any transfer defects.

In one aspect, the method determines, during a pre-rotation period, a proper transfer bias for each one of a plurality of colors. The proper transfer bias is applied to a primary transfer member, which enables transfer of the color images from a photoconductive drum so as to generate full color images. Among other steps, the method includes the steps of providing a photoconductive drum having an image region and a nonimage region, and determining a plurality of exposure bias voltages for the nonimage region, wherein each exposure bias voltage corresponds to a respective one of the plurality of colors.

For the first color, the method determines a proper transfer bias voltage by, applying a first exposure bias voltage corresponding to the first color to the photoconductive drum, and then applying at least two predetermined voltages to the primary transfer member, in order to obtain at least two currents corresponding to the two predetermined voltages during rotation of the primary transfer member.

Thereafter, the method uses the two currents and predetermined voltages to determine the proper transfer bias voltage for the first color, and for all subsequent colors, it determines a proper transfer bias voltage for each subsequent color by employing the first exposure bias voltage and the exposure bias voltage for the subsequent color.

In another aspect, the present invention provides an image forming apparatus that includes an electrifier for electrifying an image carrier; an exposure unit for forming an electrostatic latent image by exposing the electrified image carrier; a developing unit for developing the electrostatic latent image on the image carrier with toner, the developing unit having a plurality of developing devices each having toner of a mutually different color; a transfer unit that, in a transfer portion, electrostatically transfers toner images of different colors that are sequentially formed on the image carrier, to a transfer medium, with one color toner image superimposed on another, the transfer unit comprising a transfer member for causing the transfer medium to make contact with the image carrier, and a voltage applying unit for applying a voltage to the transfer member; a current detector for detecting the value of a current flowing when the voltage application by the voltage applying unit is performed; and a controller for determining, at a time except during a transfer operation, the value of a transfer voltage to be applied to the transfer member during the transfer operation, based on the detection results obtained when the current detecting operations by the current detecting unit were performed. In this image forming apparatus, based on a first detection result obtained when the current detecting operation was performed, the control means determines a first transfer voltage value to be obtained when the toner image of a first color is transferred to the transfer medium, when a non-image portion at the time during the formation of an image of a first color in the image carrier passes through the transfer portion before the toner image of the first color is transferred to the transfer medium. Also, in this image forming apparatus, based on the first detection result, the potential value of a non-image portion at the time during the formation of an image of each of a second and later colors in the image carrier, and the potential value of the non-image portion at the time during the formation of an image of the first color in the image carrier, the control means determines each transfer voltage value to be obtained when the toner image of a respective one of the second and later colors is transferred to the transfer medium.

Further features and advantages of the present invention will become apparent from the following description of the preferred embodiments with reference to the attached drawings.

DETAILED DESCRIPTION OF THE INVENTION

Hereinafter, the image forming apparatus according to the present invention will be described in more detail with reference to the accompanying drawings.

FIRST EMBODIMENT

Figure 1:
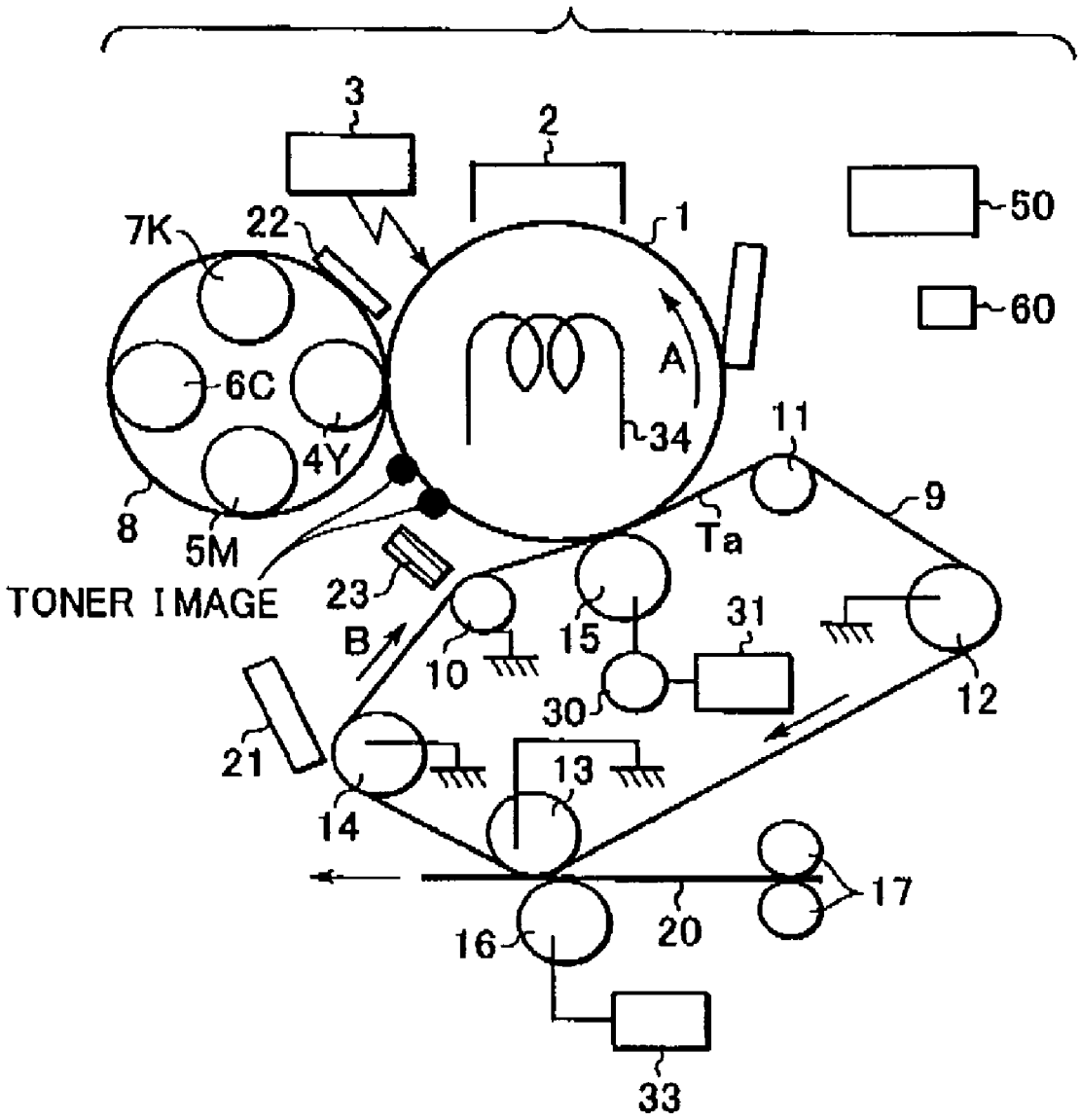
FIG. 1 is a schematic block diagram of an image forming apparatus according to an embodiment of the present invention.

FIG. 1 shows is a schematic block diagram of a color image forming apparatus according to a first embodiment of the present invention.

In FIG. 1, a photoconductive drum 1, which is a drum-shaped electro-photographic photoconductor serving as an image carrier, rotates in the direction of the arrow A. On its surface, an electrostatic latent image is formed by the well-known electro-photographic process. An electrifying means or electrifier 2 is disposed along the rotation direction of the photoconductive drum and an exposure unit 3 or image forming means exposes toner image portions on the photographic drum. For color images, toner colors for each of Y, M, C and K colors are employed. A yellow (Y) developed image (toner image) is formed from the electrostatic latent image by a developer device 4Y, mounted on a rotary developing unit 8. Under the rotation of the photoconductive drum 1, the toner image is primarily transferred to an intermediate transfer belt 9, in a primary transfer portion opposed to the intermediate transfer belt 9. Thereafter, toner images of magenta (M), cyan (C), and black (Bk), respectively, are sequentially formed on the photoconductive drum 1 in this order by the other developing devices 5M, 6C, and 7K, mounted on the rotary developing unit 8, and they are transferred onto the intermediate transfer belt 9 with one color image superimposed on another.

Potential detector 22 for detecting the surface potential of the photoconductive drum 1 is located opposite the photoconductive drum 1 between the exposure unit 3 and the rotary developing unit 8, and density detector 23 for detecting the density of a developed image (toner image) on the photoconductive drum 1 is opposed to the photoconductive drum 1 between the rotary developing unit 8 and the primary transfer portion. A drum heater 34 maintains constant the temperature around the surface of the photoconductive drum 1, and adjusts the moisture content in the atmosphere.

As described above, in the developing position of the photoconductive drum 1, there is provided the rotary developing unit 8 mounting the developing devices 4Y, 5M, 6C, and 7K corresponding to the colors yellow (Y), magenta (M), cyan (C), and black (Bk), respectively. By developing an electrostatic latent image using some of the developing devices 4Y, 5M, 6C, and 7K, a toner image is formed.

The intermediate transfer member (intermediate transfer belt) 9, functioning as a transfer medium, abuts against the surface of the photoconductive drum 1. The intermediate transfer member 9 rotates in the direction of the arrow B in a state of being tensioned by a plurality of tensioning rollers 10 to 14. In this embodiment, the tensioning rollers 10 and 11 are disposed in the vicinity of the primary transfer position, and they are driven rollers made of a metal and used for forming a flat primary transfer surface Ta of the intermediate transfer belt 9. The tensioning roller 12 is a tension roller adapted to regulate the tension of the intermediate transfer belt 9 to a constant value; the tensioning roller 14 is a driving roller for the intermediate transfer belt 9. The tensioning roller 13 is an opposed roller for a secondary transfer.

The material of the intermediate transfer belt 9 may be a resin, such as polyimide, polycarbonate, polyester, polypropylene, polyethylene terephthalate, acryl, or polyvinyl chloride, or one of various kinds of rubbers each of which contains an appropriate amount of carbon black, serving as an antistatic agent, and each of which has a volume resistivity of $10^8$ to $10^{13}$ [Ω·cm] and a thickness of 0.07 to 0.1 [mm].

The primary transfer roller 15, which serves as a transfer member, abuts against the rear surface side of intermediate transfer belt 9. By applying a transfer bias, which has the positive polarity opposed to the polarity of the electrification polarity of toner, to the primary transfer roller 15 via transfer voltage source 31, a toner image on the photoconductive drum 1 is primarily transferred onto the intermediate transfer belt 9.

As shown in FIG. 1, there is also provided a secondary transfer roller 16 abutting against the toner image carrying surface of the intermediate transfer belt 9. The tensioning roller 13, which is grounded, is disposed on the rear surface side of the intermediate transfer belt 9 and constitutes a counter electrode with respect to the secondary transfer roller 16. The secondary transfer roller 16 is subjected to a secondary transfer bias having an opposite polarity with respect to the polarity of the toner applied by secondary transfer bias source 33.

A belt cleaner 21 clears toner residue remaining on the intermediate transfer belt 9. In this embodiment, after being once positioned and stopped by registration rollers 17, the transfer material 20 is delivered to the secondary transfer position at a predetermined time. After that, the transfer material 20 is conveyed to a fixing unit (not shown) by a conveying member (not shown), and a toner image is melted and fixed to the transfer material.

Descriptions will now be given about a method for applying a proper transfer bias, in the above-described image forming apparatus, to the primary transfer roller 15 irrespective of the variations in the resistance value of the primary transfer roller.

Figure 2:
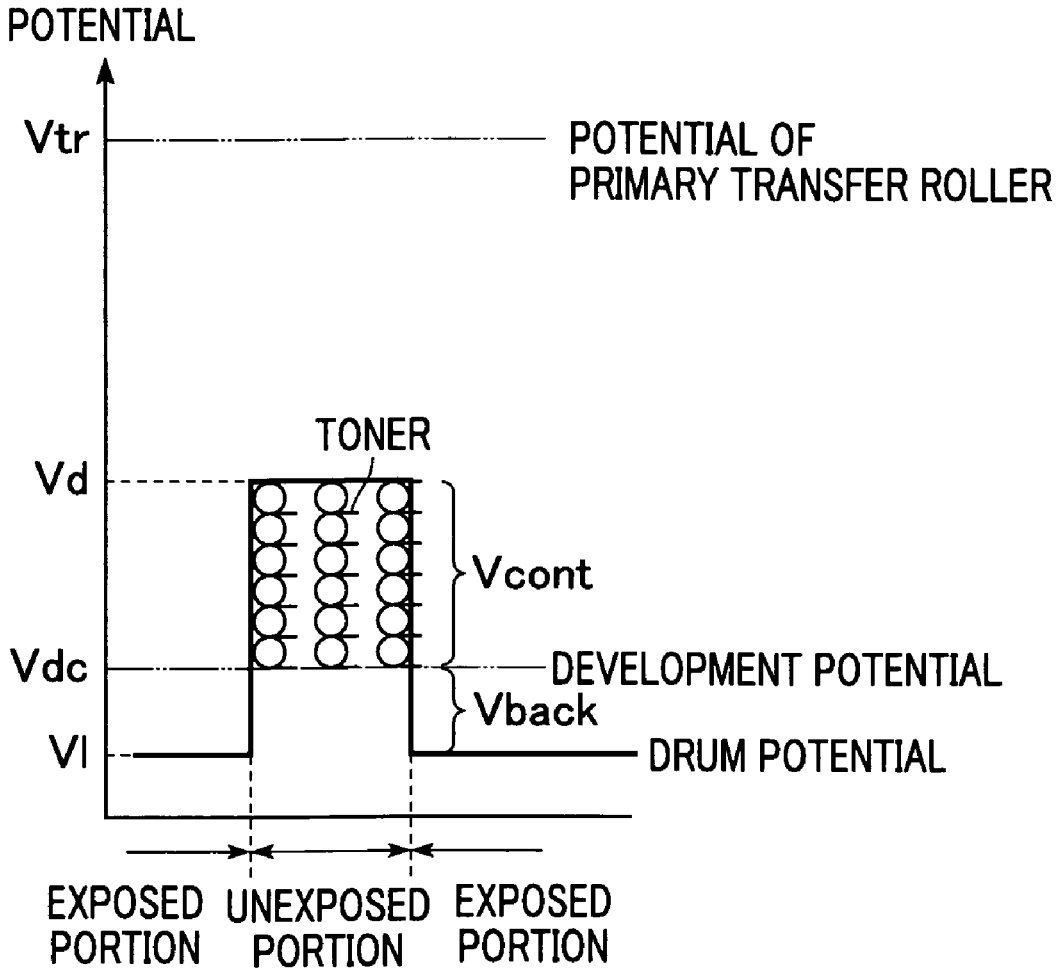
FIG. 2 is a diagram of surface potentials of an image carrier in various image forming operations according to the present invention.

Although any compatible toner type can be employed, in the present embodiment, the toner used is of a type that is negatively electrified, and of a type such that the photoconductive drum 1 is positively electrified. The developing operation is performed by the normal developing method, as shown in FIG. 2.

Here, while the potential detector 22 monitors the surface potential of the photoconductive drum 1, first the drum is uniformly electrified by the electrifier 2 to a drum potential (image portion potential) Vd, at which a toner image is developed, and the exposure unit 3 exposes a non-image portion region, where toner is not transferred onto the surface of the photoconductive drum during development, and de-staticizes the non-image portion region to the exposure potential (non-image portion potential) Vl.

In this situation, as shown in FIG. 1, in the image forming process, when the developer device 4Y moves to the developing position of the photoconductive drum 1, a development potential Vdc is applied to this developer device 4Y. The Y toner, which has been negatively charged in the developer device 4Y, moves onto the photoconductive drum 1 and becomes a first developed image (toner image), in accordance with the tribo-electric charge of the toner per unit mass (i.e., tribo) and the potential difference between the drum potential Vd on the surface of the photoconductive drum 1 and the development potential. That is, Vcont=Vd (image portion potential)−Vdc (development potential) as shown in FIG. 2.

Figure 3:
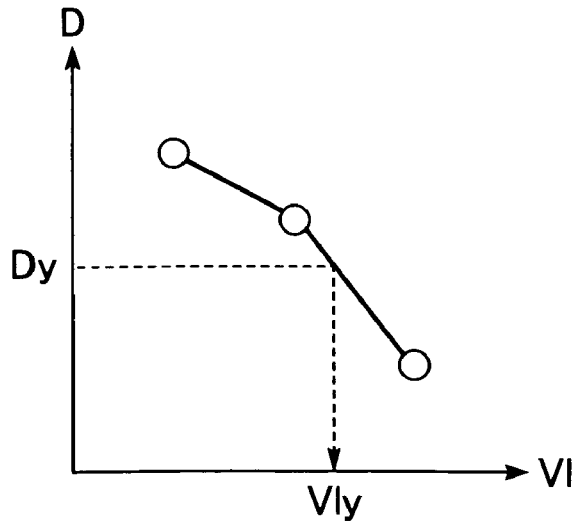
FIG. 3 is a graph showing the relationship between the non-image portion potential and the image density on the image carrier according to the present invention.

Regarding the first toner image developed, its density D is detected by density detector 23 shown in FIG. 1. Then, Vcont can be varied by maintaining Vd and Vback (which equals Vdc−Vl) fixed, and then values of Vl and Vdc are varied by adjusting the exposure amount of the exposure unit 3 in order to vary the value of Vcont. In this situation, the Y toner is again developed, and the toner density thereof is detected by the density detector 23. By repeating this operation, a proper density Dy of the Y toner and the corresponding non-image region potential Vly is determined, based on the relationship between the density D and the non-image region potential Vl, as shown in FIG. 3.

Likewise, the above processing is performed with respect to the M, C, and Bk toners of the other colors. Thereby, the exposure potentials (non-image portion potentials) Vlm, Vlc, and Vlk, respectively, allow for proper densities Dm, Dc, and Dk for each of the colors, and the respective corresponding exposure amounts by the exposure unit 3 are determined (step S3 shown in FIG. 9).

Thus, the non-image region potentials Vly, Vlm, Vlc, and Vlk for the respective colors are determined.

Figure 9:
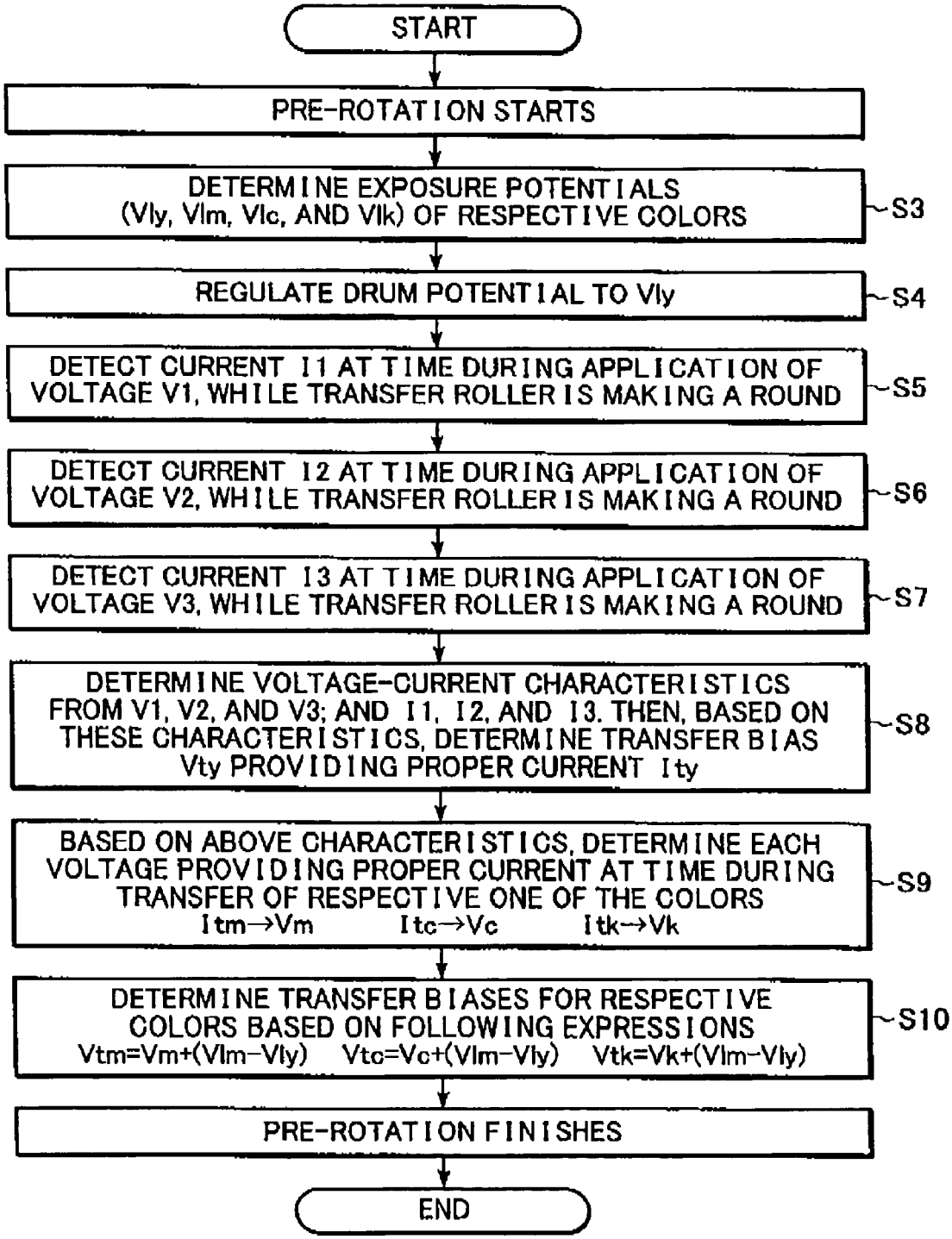
FIG. 9 is a flowchart regarding the transfer control in the present invention.

Next, with reference to the flowchart in FIG. 9, the process for determining the transfer bias to be applied to the primary transfer roller 15 will be described.

When the image forming apparatus according to this embodiment receives a signal of imaging start, first a resistance value of the primary transfer roller 15 is detected at the time when the first developed image (herein the Y toner image) formed by the developer device 4Y, serving as the first developing device, is transferred to the intermediate transfer belt 9. Specifically, before toner image is conveyed to transfer material 20, the photoconductive drum 1 is electrified to Vly determined as described above (step S4). While the primary transfer roller 15 is making a round, a first primary roller transfer bias Vl is applied thereto. For each ⅛ time period of the time period during which the primary transfer roller 15 makes a round, a respective one of the corresponding current values is detected by the current detector 30, and I1 is determined by averaging the detection results (step S5).

Figure 4:
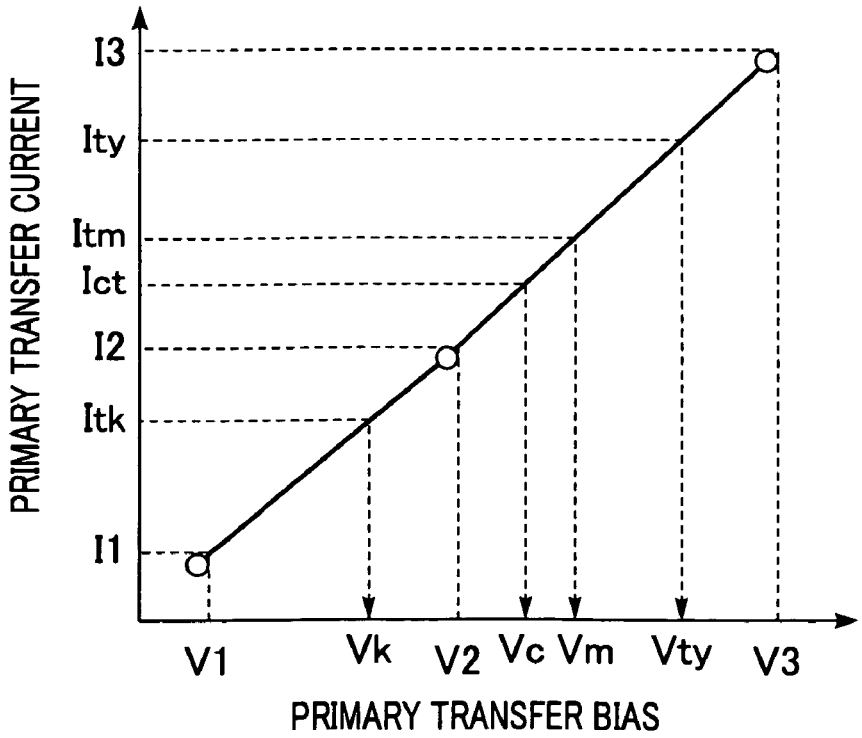
FIG. 4 is a graph showing an example of detection results of resistance values of the transfer member according to the present invention.
Figure 5:
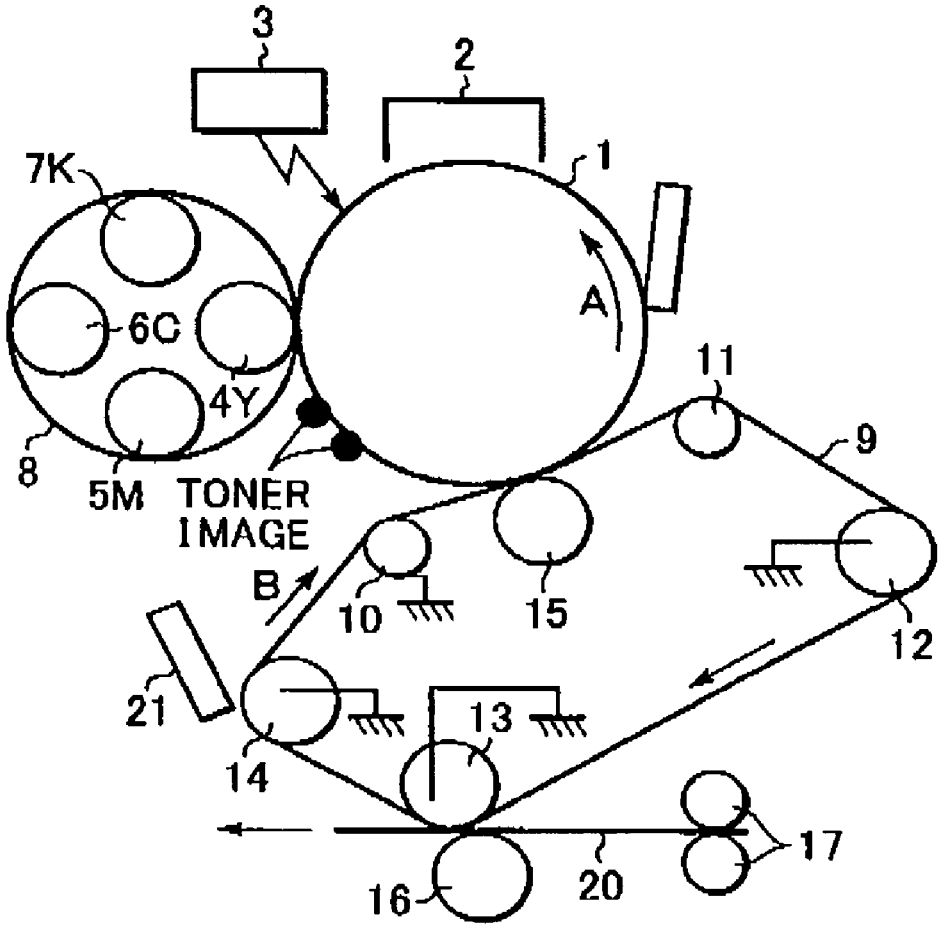
FIG. 5 PRIOR ART
FIG. 5 is a schematic block diagram showing an example of a conventional image forming apparatus.
Figure 6:
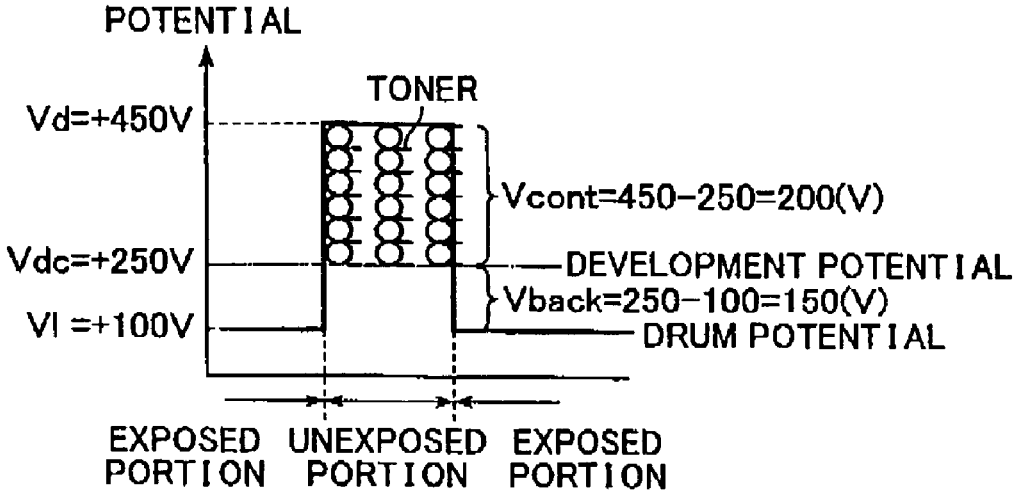
FIG. 6 PRIOR ART
FIG. 6 is a diagram showing an example of surface potentials of the image carrier in the conventional image forming apparatus.
Figure 7:
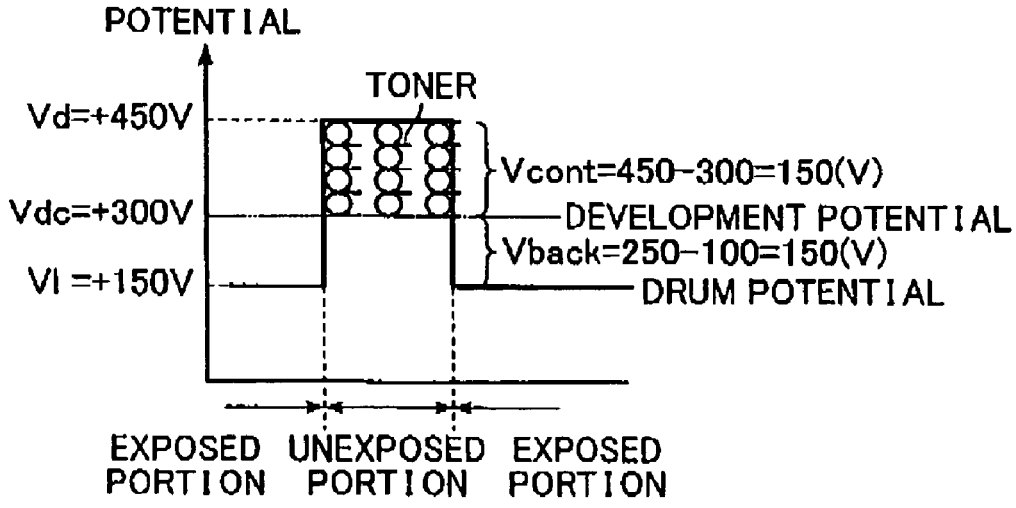
FIG. 7 PRIOR ART
FIG. 7 is a diagram showing another example of surface potentials of the image carrier in the conventional image forming apparatus.
Figure 8:
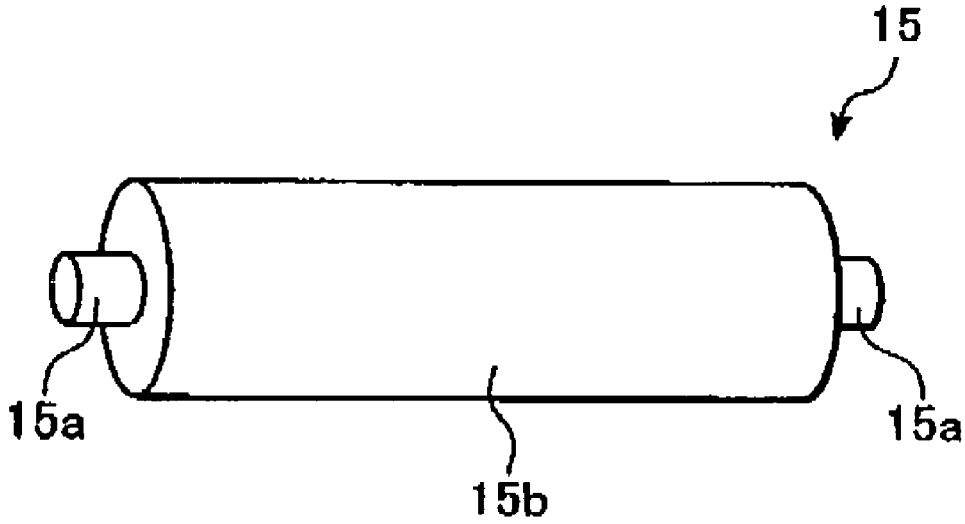
FIG. 8 PRIOR ART
FIG. 8 is a perspective view showing an example of a transfer member.

Furthermore, second and third primary roller transfer biases V2 and V3 are applied to the primary transfer roller 15, and corresponding currents I2 and I3 are determined, respectively, by the current detector 30 (steps S6 and S7). Then, by a control mechanism (not shown), serving as resistance value detecting means and provided in the image forming apparatus, a current-voltage relationship in the primary transfer portion at the time when the photoconductive drum 1 has a surface potential of Vly, that is, a detection result of the first resistance value, as shown in FIG. 4, is obtained. From this relationship, the transfer bias Vty for the Y toner image during imaging operation is determined by interpolation so that the current during the primary transfer may become a proper current Ity (step S8). In this manner, a proper transfer bias Vty can be applied to the primary transfer roller 15 to produce a proper current Ity in accordance with the present invention. Such a transfer bias control is executed by control means 50 (shown in FIG. 1).

For the Y toner image, the resistance value of the transfer bias is detected by rotating the primary transfer roller 15 once for each of the reference values V1, V2, and V3 (first, second and third primary roller transfer bias). Thus, this resistance value detection is completed in three rotations of the primary transfer roller 15.

Next, resistance value detection for determining proper bias for M, C, and BK toner images values is performed. Conventionally, resistance value detection similar to that of the first color is implemented for the other colors, which takes a relatively long time. In contrast, in the present invention, transfer biases Vtm, Vtc, and Vtk are determined by using the non-image portion region potentials (exposure potentials) Vly, Vlm, Vlc, and Vlk, which were already determined, as described above.

First, primary transfer currents to be passed in the imaging processes of the M, C, and Bk toners are assumed to be Itm, Itc, and Itk, respectively.

Since a resistance value of the primary transfer roller 15 is required (step S9), the transfer biases Vm, Vc, and Vk required to pass the currents Itm, Itc, and Itk when the photoconductive drum has a potential of Vly, are determined by interpolation from the current-voltage relationship in FIG. 4, which was determined with respect to the Y toner image, which is the first toner image. The transfer biases Vty, Vtm, Vtc, and Vtk for the respective colors are determined from formulas (1), (2), and (3) shown below (step S10). As can be seen from FIG. 2, each of the values of Vcont and Vback is common among the Y color and the other colors, and therefore, by adjusting the difference in exposure potential Vl of each of the other colors with respect to Vly, a transfer bias fitted for a respective one of the other colors can be determined, based on the detection result of the resistance value with respect to the Y toner image.

$$Vtm=Vm+(Vlm-Vly) \quad (1)$$

$$Vtc=Vc+(Vlc-Vly) \quad (2)$$

$$Vtk=Vk+(Vlk-Vly) \quad (3)$$

The use of Vty and the calculated transfer biases Vtm, Vtc, and Vtk of the respective colors makes it possible to properly impart a charge having an opposite polarity with respect to toner from the primary transfer roller 15 to the intermediate transfer belt 9 during the primary transfer of the toner of each of the colors, even though the resistance of the primary transfer roller 15 varies and values of Vl vary from color to color.

In conventional systems, when the transfer bias of the primary transfer portion is determined after the image forming apparatus has received the signal of imaging start, it has hitherto taken time corresponding to three rotations for each of the colors Y, M, C, and Bk, and twelve rotations for all these colors to obtain a current-voltage relationship in the primary transfer portion to thereby determine transfer biases, whereas in this embodiment, the time can be reduced to a time corresponding to the three rotations required to detect the resistance value with respect to the Y toner. In other words, the time period between the receipt of the signal of imaging start and the process in which the toner image is secondarily transferred to the transfer material 20 and is fixed, can be reduced. Note that this time period is also referred to as "pre-rotation" which refers to a time period for which each image forming means operates within the time period between the time point when a signal from outside is transmitted to the image forming apparatus and the time point when the signal arrives at the position where a first developed image is transferred, i.e., a transfer portion.

In the resistance value detection with respect to the first toner image, the voltage to be applied to the primary transfer roller by the transfer voltage applying means can have any levels that is not less than two. However, too many levels increase the number of rotations of the primary transfer roller, resulting in a large expenditure of time.

In this embodiment, the present invention has been implemented in an image forming apparatus of intermediate transfer type, but it can also be incorporated in an image forming apparatus in which a toner image is directly transferred from an image carrier to a transfer material, serving as a transfer medium, and more specifically, in its transfer system in which transfer is performed from the image carrier to the transfer material.

Figure 10:
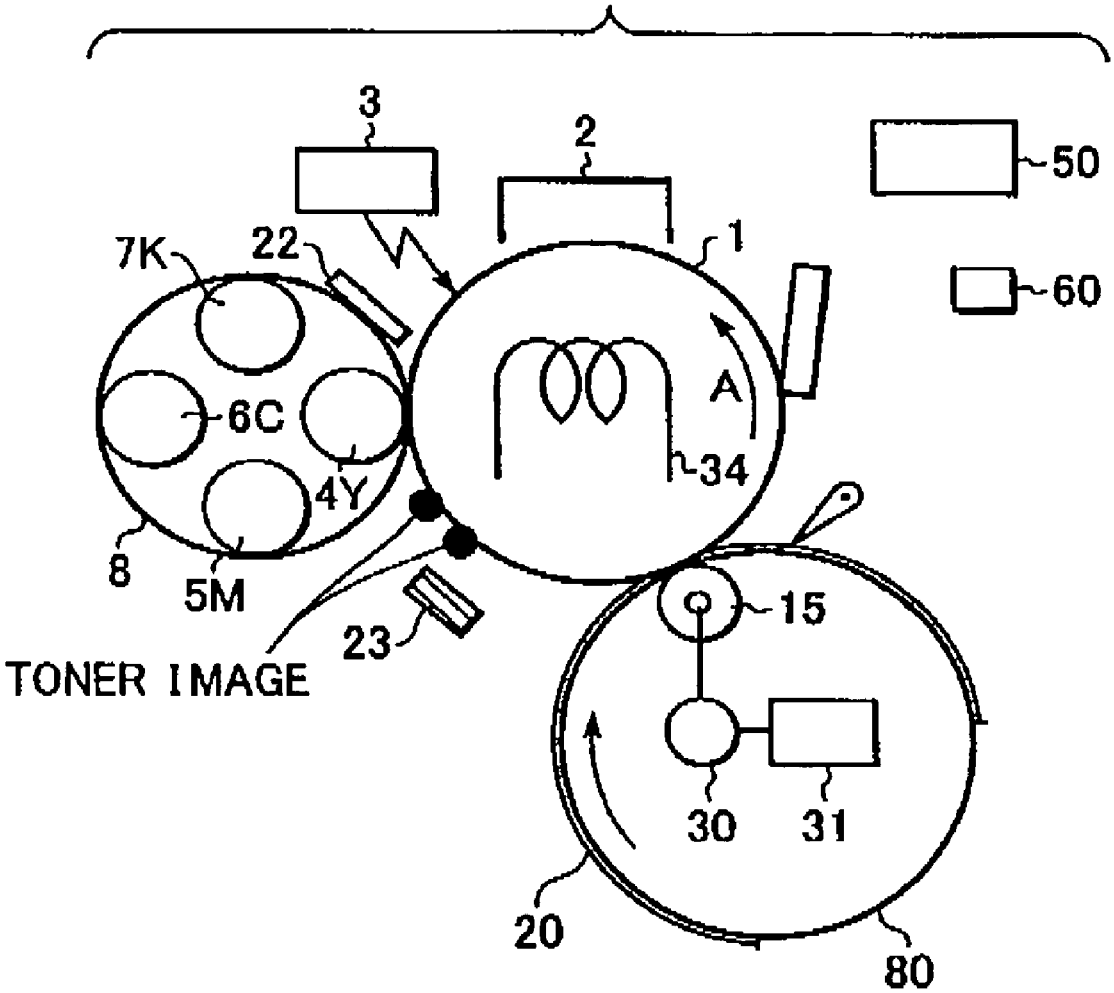
FIG. 10 is a diagram of another type of image forming apparatus to which the present invention can be applied.

For example, the present invention can also be incorporated in the transfer portion of an image forming apparatus as shown in FIG. 10. In FIG. 10, while carrying and feeding the transfer material 20 to a transfer drum 80 serving as a transfer material carrier, the apparatus transfers toner images of respective colors sequentially formed on the photoconductive drum 1 with one color image superimposed on another. The transfer material 20 after completing transfer is separated from the transfer drum 80 by a separation pawl, and conveyed to a fixing unit (not shown). The present invention can be applied to control the transfer portion using the transfer roller 15 of the present invention.

The number of developing devices and the kind of colors are not particularly limited. Furthermore, the size, material, shape, and relative position of the components and the like of the image forming apparatus described above are not restricted by any of the details of description, unless otherwise specified, but rather are to be constructed broadly within the scope of the present invention.

SECOND EMBODIMENT

As in the case of the first embodiment, in a second embodiment also, any toner used is of a type that is negatively electrified, and of a type such that the photoconductive drum 1 is positively electrified. The developing operation is performed by the normal developing method, as shown in FIG. 2.

This embodiment is different from the first embodiment only in that temperature and humidity information is used in this embodiment when determining the value of Vl for each of the colors.

While monitoring the surface potential of the photoconductive drum 1 by the potential detector 22, firstly the photoconductive drum 1 is uniformly electrified by the electrifier 2 to the potential Vd, at which a toner image is developed, and a region where no toner image is developed is exposed by the exposure unit 3 and de-staticized to the potential Vl.

In this situation, as shown in FIG. 1, when the developer device 4Y moves and is located at the developing position of the photoconductive drum 1, a developing bias, constituting a development potential Vdc, is applied to the developer device 4Y. The Y toner, which has a negative polarity developer device 4Y moves onto the photoconductive drum 1 and is developed based on both a factor known as tribo, which is the tribo-electric charge of the toner per unit mass, and a difference in potential between the drum potential Vd on the surface of the photoconductive drum 1 and the developing potential Vdc thereon produced by the developing bias, that is, Vcont=Vd−Vdc as shown in FIG. 2.

Because the tribo of toner varies depending on the absolute moisture content, for the Y toner, there exists VcontY, which is Vcont at which a proper toner is developed with some absolute moisture content provided. The same goes for the other colors M, C, and Bk. Therefore, with equal absolute moisture contents provided, the proper values of Vcont of the respective colors Y, M, C, and Bk, that is, VcontY, VcontM, Vcont C, and VcontBk are determined. Accordingly, fixing Vd and Vback, and adjusting Vcont of the respective colors allow the Vl values of the Y, M, C, Bk toners of the respective colors, that is, Vly, Vlm, Vlc, and Vlk, to be naturally determined.

In this embodiment, therefore, Vl values fitted for the respective colors are determined in advance for each of the absolute moisture contents, which are based on temperature and humidity information sensed by temperature and humidity sensor 60.

Here, while monitoring the surface potential of the photoconductive drum 1 by the potential detector 22, the photoconductive drum 1 is uniformly electrified by the electrifier 2 to the potential Vd, at which a toner image is developed, and then exposure amounts in which the non-image region potentials Vly, Vlm, Vlc, and Vlk for the respective colors are provided by the exposure unit 3, are determined.

Next, the control with respect to the transfer bias to be applied to the primary transfer roller 15, will be described.

When the image forming apparatus according to this embodiment receives a signal of imaging start, as in the case of the first embodiment, without the conveyance of the transfer material 20, firstly the photoconductive drum 1 is electrified to Vly determined by now, and while the primary transfer roller 15 is making a round, a transfer bias V1 is applied thereto. For each ⅛ time period of the time period during which the primary transfer roller 15 makes a round, a respective one of corresponding current values is detected by the current detector 30, and I1 is determined by averaging the detection results.

Furthermore, transfer biases V2 and V3 are applied to the primary transfer roller 15, and corresponding currents I2 and I3 are determined, respectively, by the detection by the current detector 30. Then, by a control mechanism (not shown) serving as resistance value detecting means and provided in the image forming apparatus, a current-voltage relationship in the primary transfer portion at the time when the photoconductive drum 1 has a surface potential of Vly is obtained, as shown in FIG. 4. From this relationship, the transfer bias Vty for the Y toner image during imaging operation is determined by interpolation so that the current during the primary transfer may become a proper current Ity.

The transfer biases Vtm, Vtc, and Vtk for M, C, and BK toner images of the other colors are determined as described below by using the non-image portion region potentials (exposure potentials) Vly, Vlm, Vlc, and Vlk, which have been determined above.

First, primary transfer currents to be passed in the imaging processes of the M, C, and Bk toners are assumed to be Itm, Itc, and Itk, respectively. The transfer biases Vm, Vc, and Vk required to pass the currents Itm, Itc, and Itk when the photoconductive drum has a potential of Vly, are determined by interpolation from the current-voltage relationship in FIG. 4, which has been determined by the resistance value detection with respect the Y toner image, which is the first toner image. The transfer biases Vty, Vtm, Vtc, and Vtk of the respective colors are determined by calculating the following formulas (4), (5), and (6).

$$Vtm=Vm+(Vlm-Vly) \quad (4)$$

$$Vtc=Vc+(Vlc-Vly) \quad (5)$$

$$Vtk=Vt+(Vlk-Vly) \quad (6)$$

The use of the calculated transfer biases Vty, Vtm, Vtc, and Vtk of the respective colors makes it possible to properly impart a charge having an opposite polarity with respect to toner from the primary transfer roller 15 to the intermediate transfer belt 9 during the primary transfer of the toner of each of the colors, even though the resistance of the primary transfer roller 15 varies and values of Vl vary from a color to color.

As described above, when the transfer bias with respect to the primary transfer portion is determined after the image forming apparatus has received the signal of imaging start, it has hitherto taken time corresponding to three rotations for each of the colors Y, M, C, and Bk, and twelve rotations for all these colors to obtain a current-voltage relationship in the primary transfer portion to thereby determine transfer biases. However, in this embodiment, as in the case of the first embodiment, the time can be reduced to a time required for three rotations. In other words, the time between the receipt of the signal of imaging start and the process in which the toner image is secondarily transferred to the transfer material 20 and is fixed, can be reduced.

As described above, in this embodiment, by sensing an absolute moisture content in the apparatus by the temperature and humidity information sensing means, and thereby adjusting the exposure potential to detect the resistance value, it is possible to stably apply a proper transfer bias even if environmental conditions widely vary.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for determining a proper transfer bias for each one of a plurality of colors, wherein said proper transfer bias is applied to a primary transfer member which enables transfer of said color images from a photoconductive drum so as to generate full color images, the method comprising:

providing a photoconductive drum having an image region and a nonimage region;

determining a plurality of nonimage potentials for the nonimage region, wherein each nonimage potential corresponds to a respective one of the plurality of colors;

for said first color, determining a proper transfer bias voltage by, applying a first nonimage potential corresponding to the first color to the photoconductive drum, applying at least two predetermined voltages to the primary transfer member, obtaining at least two currents corresponding to said two predetermined voltages during rotation of said primary transfer member, and using the two currents and predetermined voltages to determine the proper transfer bias voltage for the first color; and for all subsequent colors, determining a proper transfer bias voltage for each subsequent color by employing the first nonimage potential and the nonimage potential for the subsequent color.

2. The method of claim 1 wherein the primary transfer member is a primary transfer roller.

3. The method of claim 2, wherein the primary transfer roller is rotated only twice during pre-rotation, and wherein said proper transfer bias voltages for the first and subsequent colors are determined within no more than said two rotations.

4. The method of claim 2 wherein the primary transfer roller only makes a number of rotations during pre-rotation, and wherein said number of rotations is determined by the number of predetermined voltages applied to the primary transfer roller.

5. The method of claim 2 wherein said step of determining a proper transfer bias voltage for each subsequent color excludes applying the exposure bias voltage for that subsequent color to the primary transfer roller.

6. An image forming apparatus comprising:

electrifying means for electrifying an image carrier;

exposure means for forming an electrostatic latent image by exposing the electrified image carrier;

developing means for developing the electrostatic latent image on the image carrier with toner, the developing means having a plurality of developing devices each having toner of a mutually different color;

transfer means that, in a transfer portion, electrostatically transfers toner images of different colors that are sequentially formed on the image carrier, to a transfer medium, with one color toner image superimposed on another, the transfer means comprising a transfer member for causing the transfer medium to make contact with the image carrier, and voltage applying means for applying a voltage to the transfer member;

current detecting means for detecting the value of a current flowing when the voltage application by the voltage applying means is performed; and control means for determining, at a time except during a transfer operation, a value of a transfer voltage to be applied to the transfer member during the transfer operation, based on the detection results obtained when a current detecting operations by the current detecting means were performed, wherein, based on a first detection result obtained when the current detecting operation was performed, the control means determines a first transfer voltage value to be obtained when the toner image of a first color is transferred to the transfer medium, when a non-image portion at the time during the formation of an image of a first color in the image carrier passes through the transfer portion before the toner image of the first color is transferred to the transfer medium; and wherein, based on the first detection result, a potential value of a non-image portion at the time during the formation of an image of each of a second and later colors in the image carrier, and a potential value of the non-image portion at the time during the formation of an image of the first color in the image carrier, the control means determines each transfer voltage value to be obtained when the toner image of a respective one of the second and later colors is transferred to the transfer medium.

7. The image forming apparatus according to claim 6, wherein:

the exposure means exposes a non-image portion;

the developing means develops an unexposed portion on the image carrier with toner, the unexposed portion being not subjected to an exposure by the exposure means;

the non-image portion at the time during the formation of an image of the first color in the image carrier is an exposed portion at the time during the formation of an image of the first color; and the non-image portion at the time during the formation of an image of each of second and later colors in the image carrier is an exposed portion at the time during the formation of an image of a respective one of the second and later colors.

8. The image forming apparatus according to claim 6, wherein the control means performs the current detecting operation by detecting respective corresponding current values at the time when a plurality of predetermined voltages is applied.

9. The image forming apparatus according to claim 6, further comprising temperature and humidity sensing means for sensing temperature and humidity, and wherein the potential of a non-image portion during image formation is determined based on temperature and humidity information obtained by the temperature and humidity sensing means.

10. The image forming apparatus according to claim 6, wherein the potential of a non-image portion during image formation can be set for each toner color.

11. The image forming apparatus according to claim 10, further comprising density sensing means for sensing the density of a toner image formed on the image carrier, wherein the toner image of each color formed under a predetermined image forming condition is sensed by the density sensing means, and wherein the potential of the non-image portion at the time during the formation of an image of each color in the image carrier is determined in accordance with the sensing result by the density sensing means.

12. The image forming apparatus according to claim 6, wherein the transfer medium is an intermediate transfer member.

13. The image forming apparatus according to claim 6, wherein the transfer medium is a transfer material.

14. A method for determining a proper transfer bias for each one of a plurality of colors to produce electrostatic or electrographic color images, the method comprising:

providing an image carrier to carry color toner images;

determining a plurality of nonimage potentials for a nonimage region of the image carrier, wherein each nonimage potential corresponds to a respective one of the plurality of colors;

for said first color, determining a proper transfer bias voltage by, applying a first nonimage potential corresponding to the first color to the photoconductive drum, and applying three predetermined voltages to the primary transfer member, obtaining three currents corresponding to said three predetermined voltages during rotation of said primary transfer member, and using the three currents and predetermined voltages to determine the proper transfer bias voltage for the first color; and for all subsequent colors, determining a proper transfer bias voltage for each subsequent color by employing the first nonimage potential and the nonimage potential for the subsequent color, wherein said proper transfer bias voltages for the first and subsequent colors are determined within no more than three rotations of the primary transfer member.

15. The method of claim 14 wherein the primary transfer member is a primary transfer roller.

* * * * *